US006935620B1

(12) United States Patent
Wilson

(10) Patent No.: US 6,935,620 B1
(45) Date of Patent: Aug. 30, 2005

(54) RAILROAD E-CLIP REMOVAL SYSTEM

(76) Inventor: Timothy R. Wilson, 1805-2nd Ave. North, Moorhead, MN (US) 56560

( * ) Notice: Subject to any disclaimer, the term of this patent is extended or adjusted under 35 U.S.C. 154(b) by 66 days.

(21) Appl. No.: 10/627,488

(22) Filed: Jul. 25, 2003

(51) Int. Cl.[7] ..... B25C 11/00
(52) U.S. Cl. ..... 254/18; 29/243.56
(58) Field of Search ..... 254/18; 29/243.56, 29/222, 263, 238, 239

(56) References Cited

U.S. PATENT DOCUMENTS 5,810,333 A * 9/1998 Hickerson et al. ..... 254/93 R
6,015,136 A * 1/2000 Benudiz ..... 254/18
6,526,641 B1 * 3/2003 Latham ..... 29/239

* cited by examiner

*Primary Examiner*—Lee D. Wilson
(74) *Attorney, Agent, or Firm*—Michael S. Neustel

(57) ABSTRACT

A railroad e-clip removal system for efficiently and safely removing railroad e-clips from a railroad track. The railroad e-clip removal system includes an outer tube with an outer cutout, an inner tube slidably positioned within a lumen of the outer tube, an inner cutout within the inner tube having an engaging portion, and an actuator unit attached to the tubes for extending/retracting the inner tube within the outer tube. The engaging portion of the inert tube engages a portion of an e-clip when the actuator unit is extended thereby forcing the e-clip from a tubular support member attached to a rail pad. The e-clip is thereby safely and efficiently removed from the railroad track.

19 Claims, 11 Drawing Sheets

(Exemplary E-Clip System)

RAILROAD E-CLIP REMOVAL SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to railroad e-clip removing devices and more specifically it relates to a railroad e-clip removal system for efficiently and safely removing railroad e-clips from a railroad track.

2. Description of the Related Art

Railroad clip members, such as e-clips, have been in use for years. Conventional e-clips are slidably positioned within a tubular support member attached to a rail pad as shown in FIG. 1 of the drawings. E-clips are comprised of a resilient metal that grip the rail under vibrating conditions without damage. Conventional methods of removing e-clips are typically comprised of utilizing a hammer to drive the e-clips from the tubular support member or elongate bar members utilized to pry the e-clips from the tubular support member.

Conventional methods and tools for removing e-clips from a railroad track are cumbersome. In additional, these methods and tools are not safe to remove e-clips which are under significant stress and forces when securing a rail member thereby causing them to "shoot outwardly" after being released from the tubular support member. Also, it is time consuming to manually remove e-clips from the tubular support member.

While these devices may be suitable for the particular purpose to which they address, they are not as suitable for efficiently and safely removing railroad e-clips from a railroad track. Conventional methods and tools for removing e-clips from railroad tracks are difficult to utilize and inherently dangerous to the worker.

In these respects, the railroad e-clip removal system according to the present invention substantially departs from the conventional concepts and designs of the prior art, and in so doing provides an apparatus primarily developed for the purpose of efficiently and safely removing railroad e-clips from a railroad track.

BRIEF SUMMARY OF THE INVENTION

In view of the foregoing disadvantages inherent in the known types of e-clip removal devices now present in the prior art, the present invention provides a new railroad e-clip removal system construction wherein the same can be utilized for efficiently and safely removing railroad e-clips from a railroad track.

The general purpose of the present invention, which will be described subsequently in greater detail, is to provide a new railroad e-clip removal system that has many of the advantages of the railroad clip removal devices mentioned heretofore and many novel features that result in a new railroad e-clip removal system which is not anticipated, rendered obvious, suggested, or even implied by any of the prior art railroad clip removal system, either alone or in any combination thereof.

To attain this, the present invention generally comprises an outer tube with an outer cutout, an inner tube slidably positioned within a lumen of the outer tube, an inner cutout within the inner tube having an engaging portion, and an actuator unit attached to the tubes for extending/retracting the inner tube within the outer tube. The engaging portion of the inert tube engages a portion of an e-clip when the actuator unit is extended thereby forcing the e-clip from a tubular support member attached to a rail pad. The e-clip is thereby safely and efficiently removed from the railroad track.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a railroad e-clip removal system that will overcome the shortcomings of the prior art devices.

A second object is to provide a railroad e-clip removal system for efficiently and safely removing railroad e-clips from a railroad track.

Another object is to provide a railroad e-clip removal system that does not allow the e-clip to accidentally hit a worker.

An additional object is to provide a railroad e-clip removal system that significantly reduces the amount of manual labor required to remove an e-clip.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
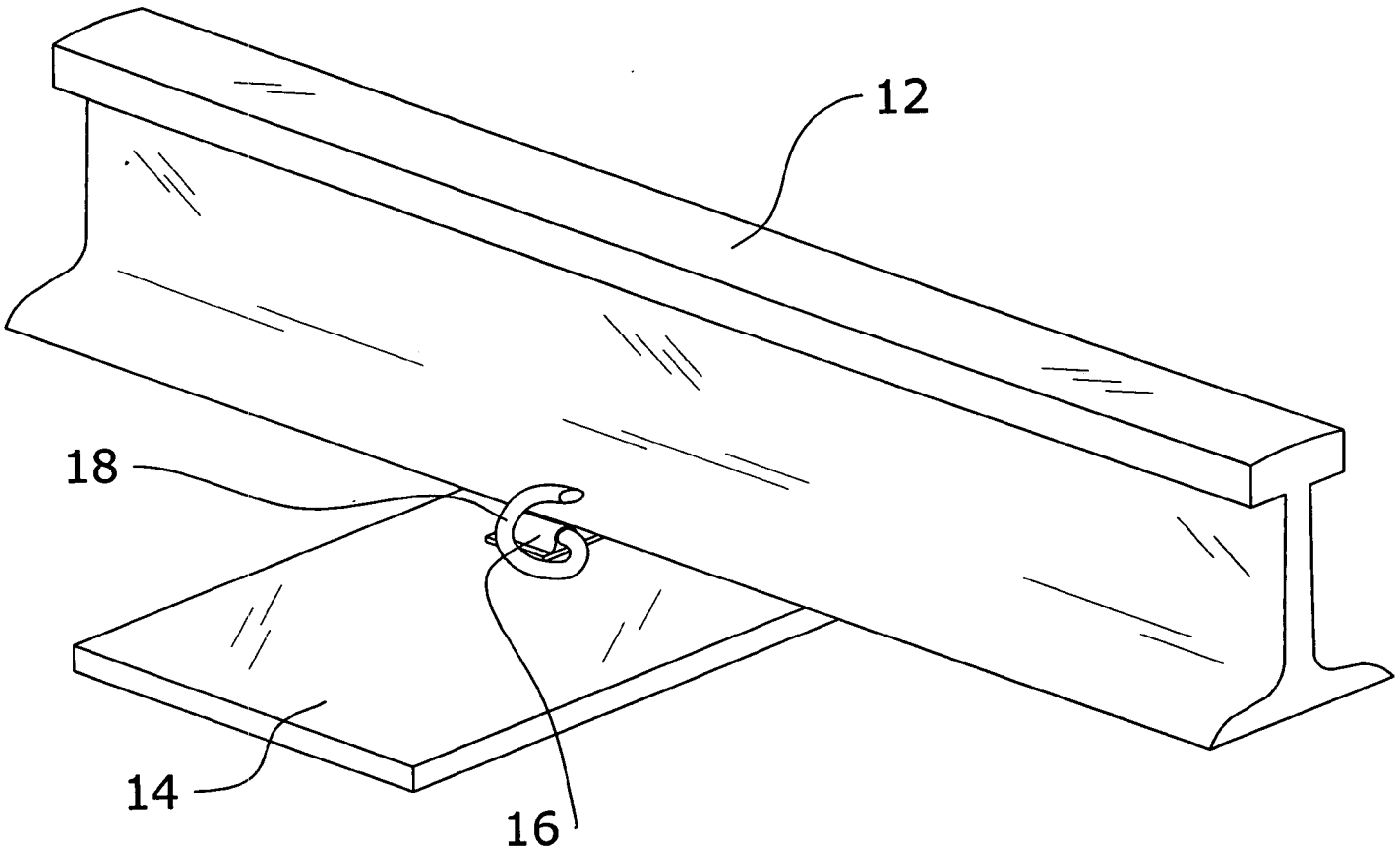
FIG. 1 is an upper perspective view of an e-clip attached to a tubular support member for retaining a rail member of a railroad track.

Turning now descriptively to the drawings, in which similar reference characters denote similar elements throughout the several views, FIGS. 1 through 11 illustrate a railroad e-clip removal system 10, which comprises an outer tube 20 with an outer cutout 26, an inner tube 30 slidably positioned within a lumen 24 of the outer tube 20, an inner cutout 34 within the inner tube 30 having an engaging portion 32, and an actuator unit 40 attached to the tubes for extending/retracting the inner tube 30 within the outer tube 20. The engaging portion 32 of the inert tube engages a portion of an e-clip 18 when the actuator unit 40 is extended thereby forcing the e-clip 18 from a tubular support member 16 attached to a rail pad 14. The e-clip 18 is thereby safely and efficiently removed from the railroad track.

B. Outer Tube

Figure 3:
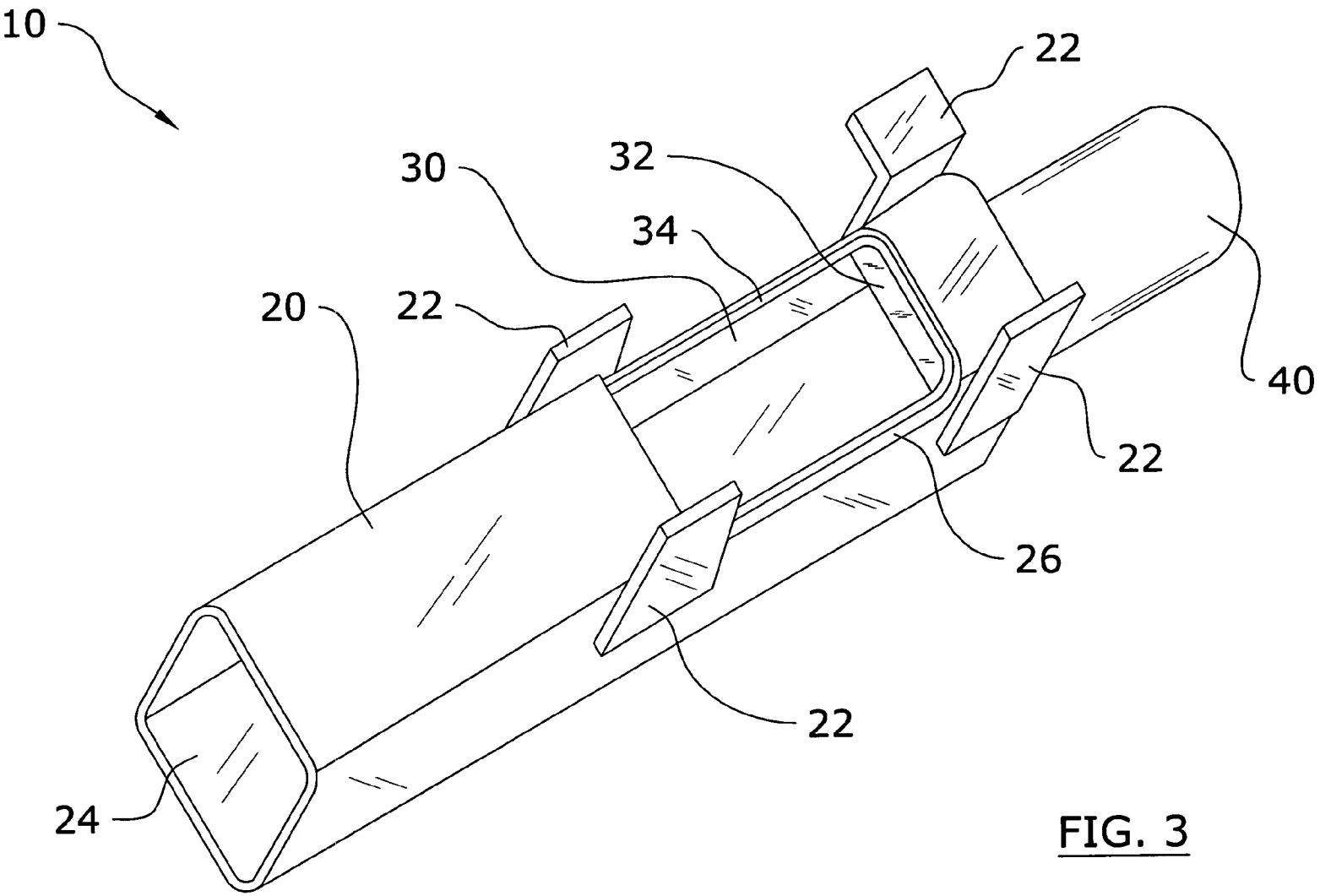
FIG. 3 is a lower perspective view of the present invention.

The outer tube 20 has an elongate structure with an outer cutout 26 as best shown in FIG. 3 of the drawings. The outer tube 20 may have various cross sectional shapes such as rectangular, square, oval, circular and the like.

Figure 2:
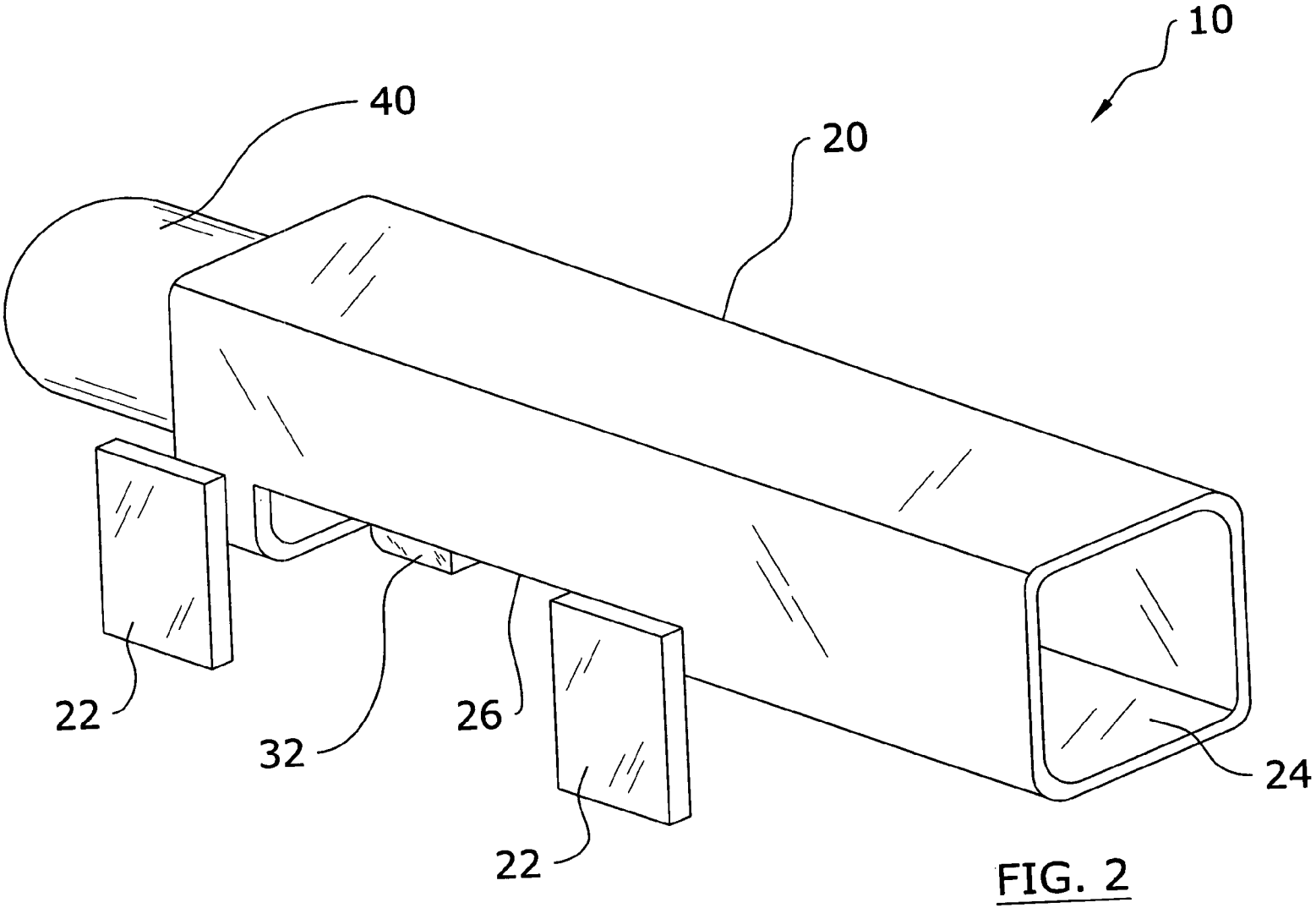
FIG. 2 is an upper perspective view of the present invention.
Figure 4:
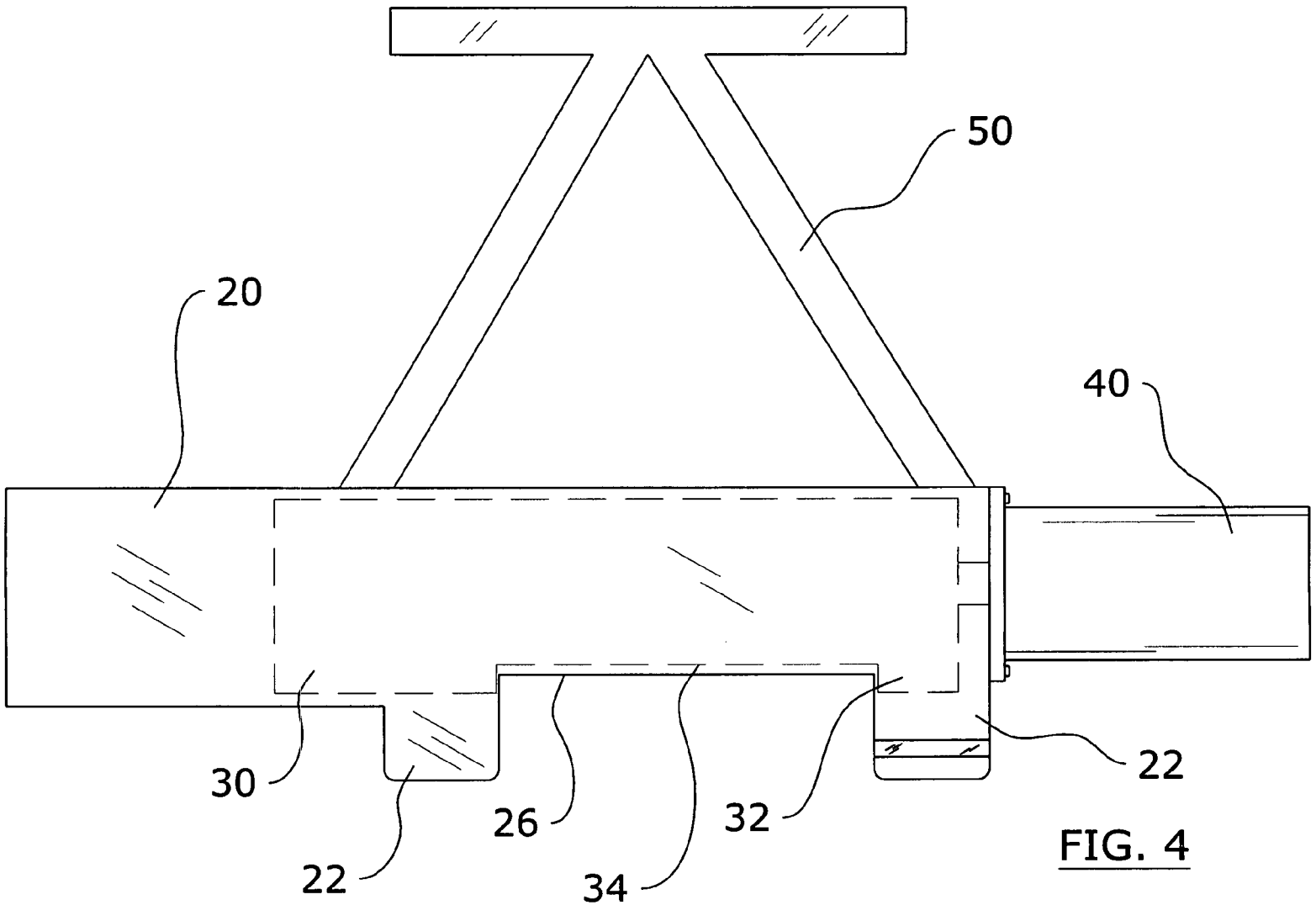
FIG. 4 is a side view of the present invention with the inner tube retracted.

The outer tube 20 has an inner lumen 24 that slidably receives the inner tube 30 as shown in FIGS. 2 and 3 of the drawings. As shown in FIG. 4 of the drawings, the outer tube 20 is preferably longer in length than the inner tube 30. The outer tube 20 provides support and stability to the inner tube 30 when the engaging portion 32 of the inner tube 30 is engaging the e-clip 18.

Figure 5:
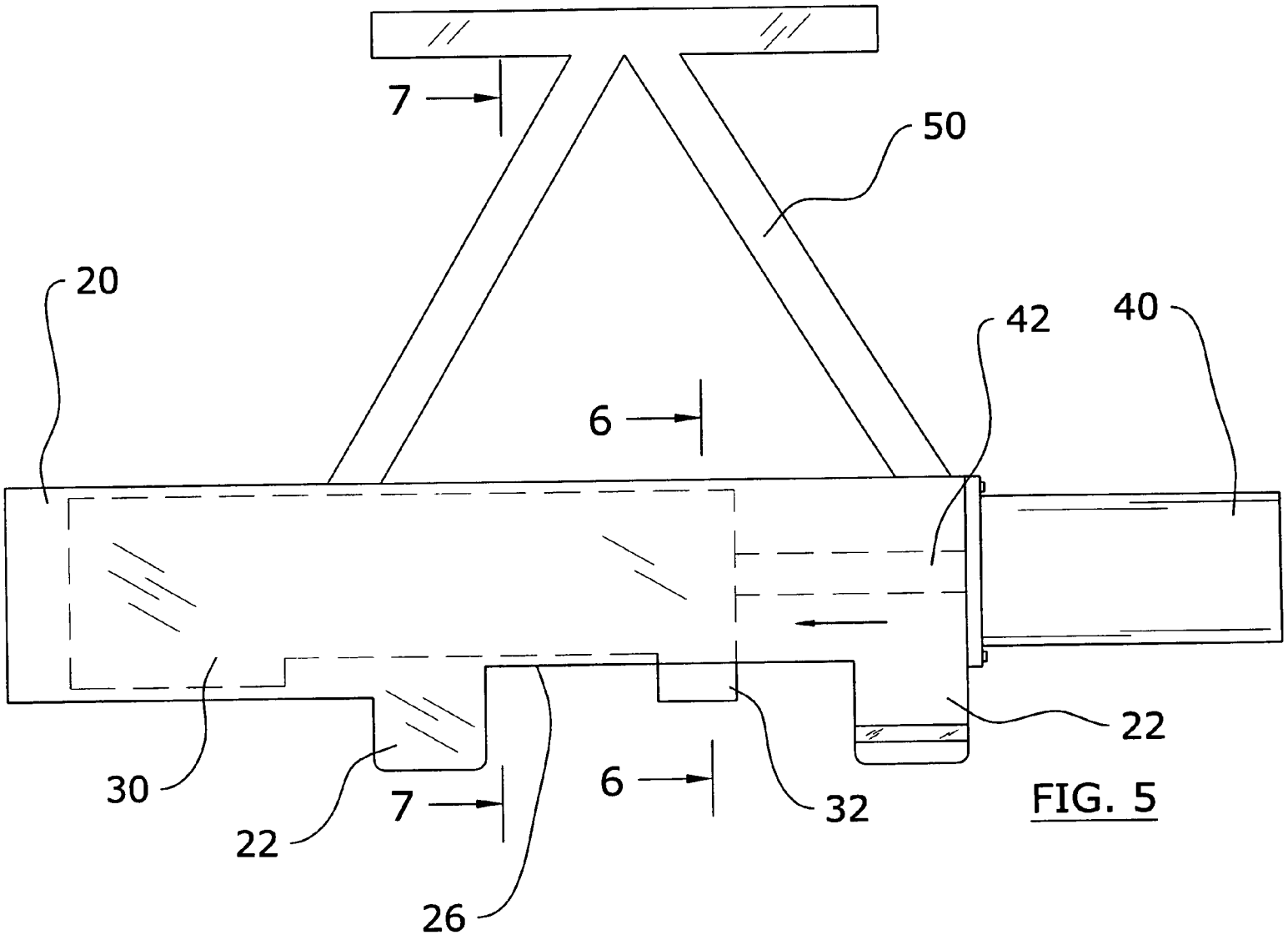
FIG. 5 is a side view of the present invention with the inner tube extended.

As shown in FIGS. 2 through 5 of the drawings, a plurality of legs 22 are attached to the outer tube 20. The legs 22 are preferably on the outside portions of the outer tube 20 for providing support and stability to the outer tube 20 during usage. One of the legs 22 is preferably engageable to a tubular support member 16 during removal of an e-clip 18 (i.e. the leg that is positioned between the tubular support member 16 and the rail member 12). In addition, one of the legs 22 is preferably shorter than the other legs 22 and has a flanged portion for being positioned upon a rail foot of a rail member 12 as shown in FIGS. 3 and 5 of the drawings.

C. Support Structure

As shown in FIGS. 4, 5, 10 and 11 of the drawings, a support structure 50 having is attached to the outer tube 20 for allowing the user to manipulate the present invention. The support structure 50 preferably includes a handle member 52 attached to the outer tube 20 as further shown in FIGS. 4, 5, 10 and 11. The support structure 50 may be comprised of various structures other than shown in the figures.

D. Inner Tube

The inner tube 30 is slidably positioned within the lumen 24 of the outer tube 20 as shown in FIGS. 3 through 5 of the drawings. The outer tube 20 and the outer tube 20 preferably have a similar cross sectional shape, however the tubes 20, 30 may have differing cross section shapes.

Figure 11:
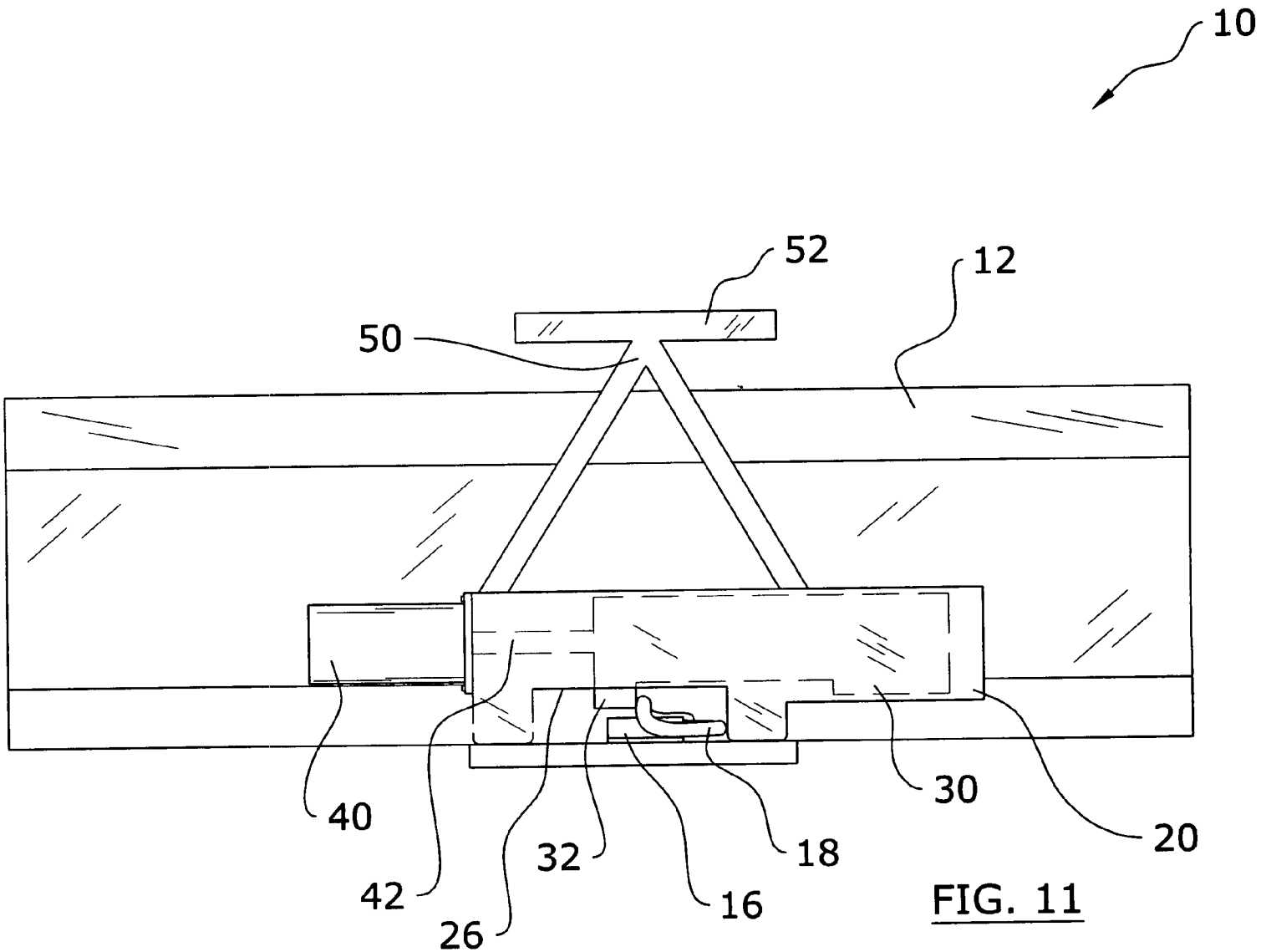
FIG. 11 is a side view of the present invention positioned about an e-clip to be removed.

The inner tube 30 includes an inner cutout 34 and an engaging portion 32 as further shown in FIG. 3 of the drawings. The outer cutout 26 and the inner cutout 34 are preferably similar in position and size. The engaging portion 32 is engageable to an e-clip 18 for forcing the e-clip 18 from the tubular support member 16 as shown in FIG. 11 of the drawings.

Figure 8:
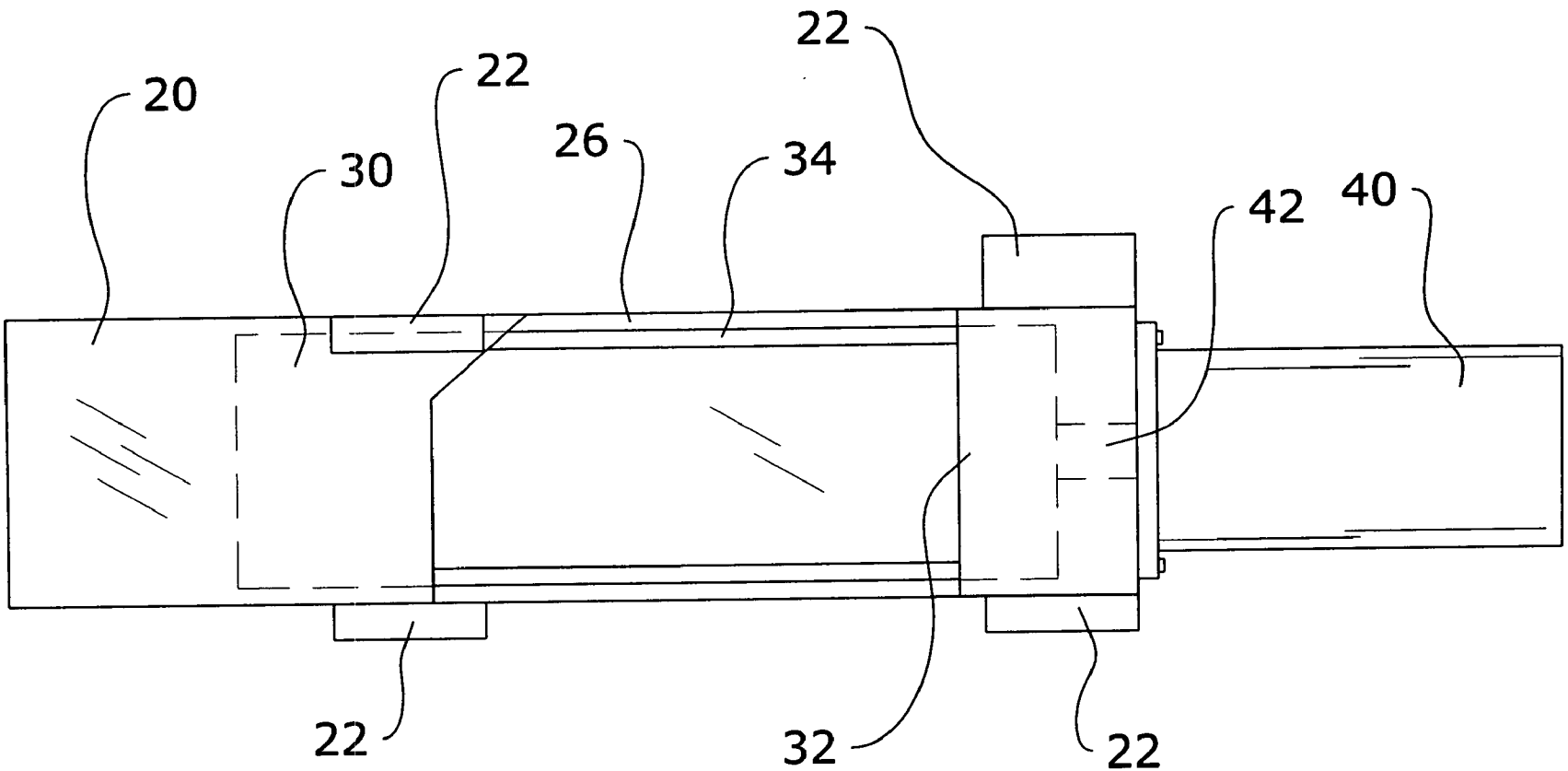
FIG. 8 is a bottom view of the present invention with the inner tube retracted.
Figure 9:
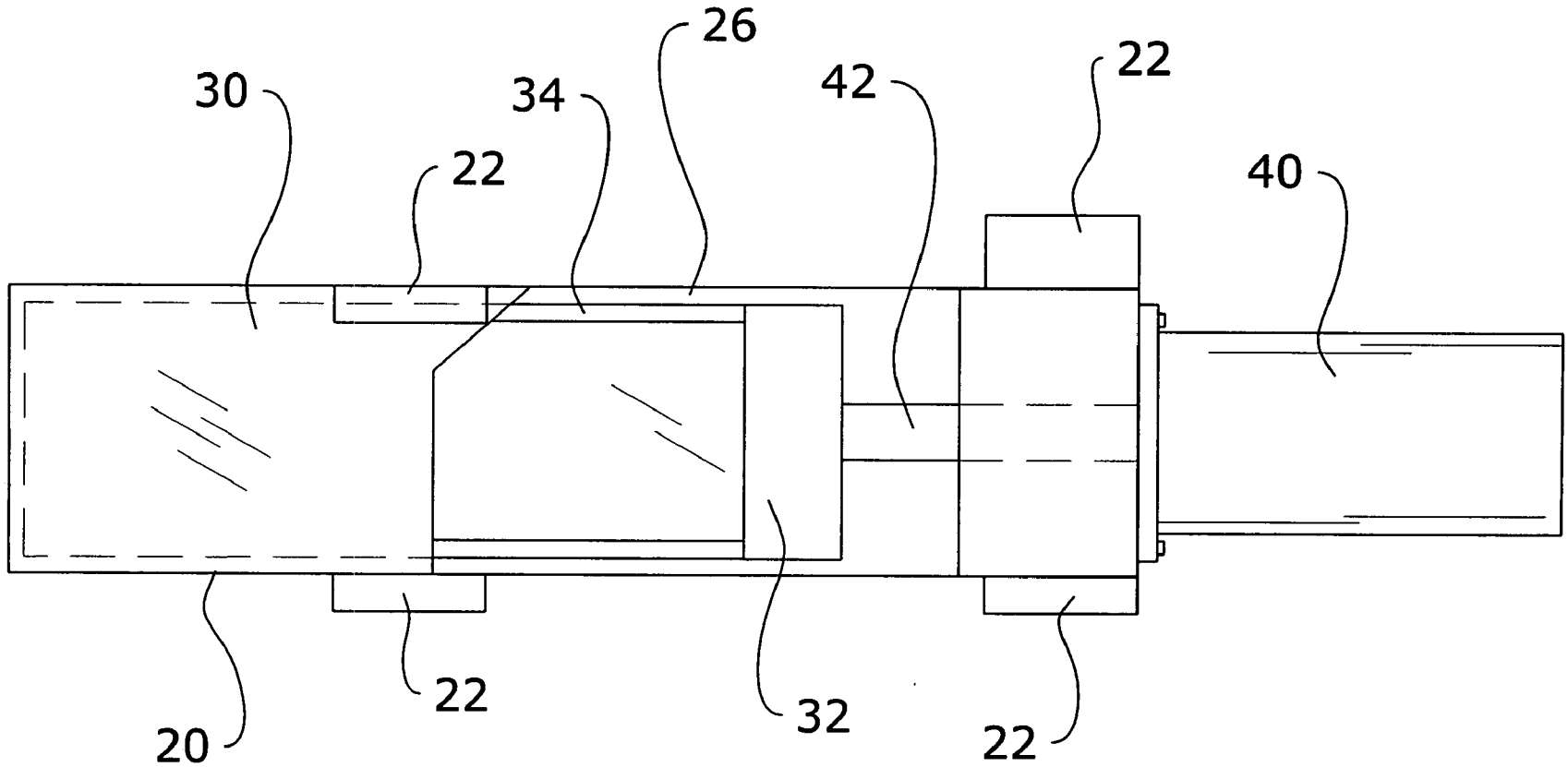
FIG. 9 is a bottom view of the present invention with the inner tube extended.

The engaging portion 32 is comprised of a lower rear edge of the inner cutout 34 as best illustrated in FIGS. 3, 8 and 9 of the drawings. The engaging portion 32 is positioned near a rear portion of the outer cutout 26 when the inner tube 30 is retracted as shown in FIG. 4 of the drawings. The engaging portion 32 also preferably extends below the outer cutout 26 for engaging the e-clip 18 as best shown in FIG. 5 of the drawings.

E. Actuator Unit

The actuator unit 40 is attached to the outer tube 20 and includes an extendable/retractable shaft member 42 as shown in FIGS. 3 through 9 of the drawings. The actuator unit 40 may be comprised of any type of conventional actuator such as but not limited to electrical actuator, hydraulic cylinder and the like. A control switch is preferably attached to the support structure 50 for allowing the user to control the actuator unit 40. If a hydraulic cylinder is utilized for the actuator unit 40, a hydraulic fluid source is needed to operate the present invention.

Figure 6:
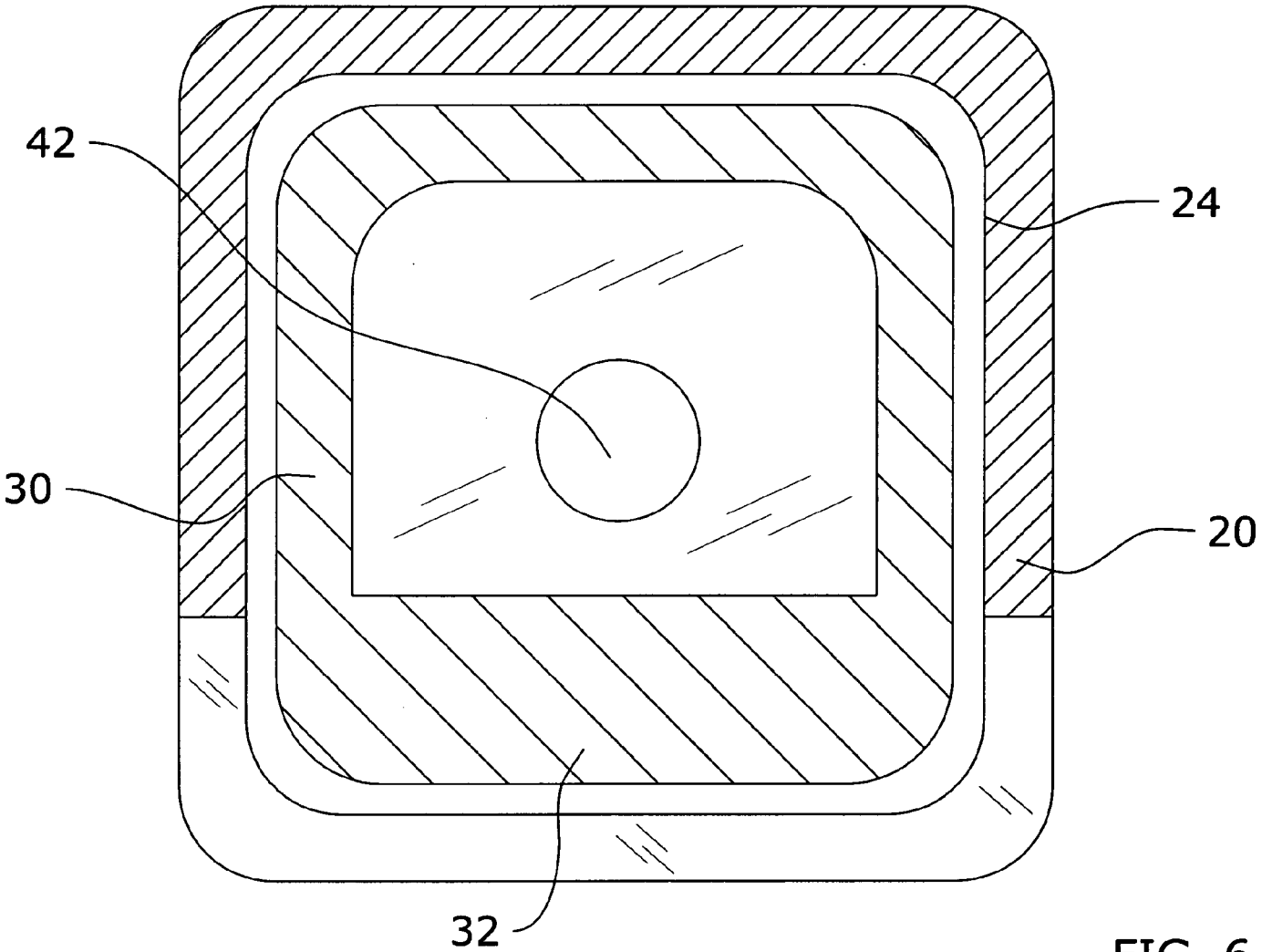
FIG. 6 is a cross sectional view taken along line 6—6 of FIG. 5.
Figure 7:
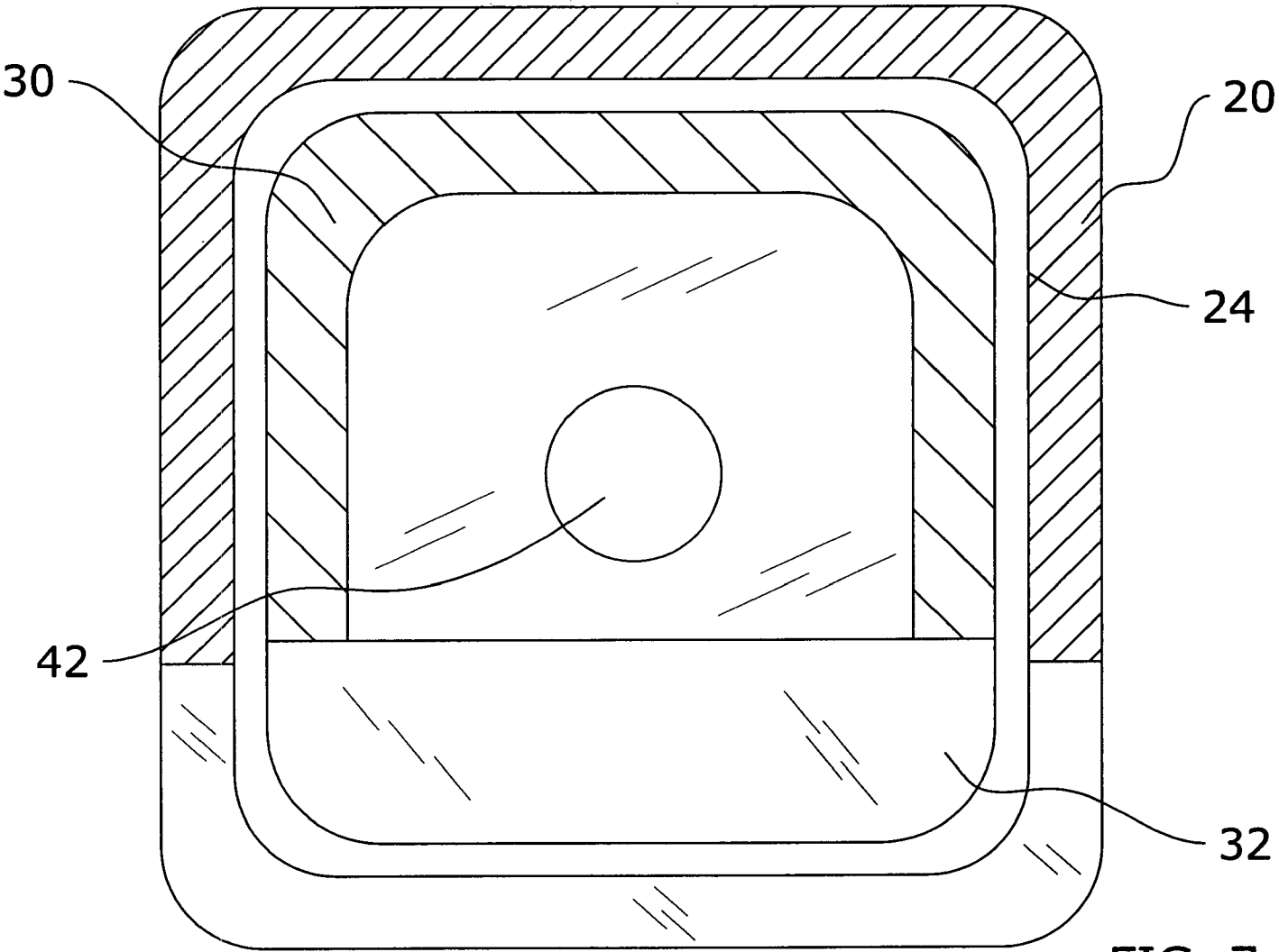
FIG. 7 is a cross sectional view taken along line 7—7 of FIG. 5.

The shaft member 42 is attached to the rear end of the inner tube 30 as shown in FIGS. 6 and 7 of the drawings. The actuator unit 40 extends/retracts the inner tube 30 with respect to the outer tube 20 thereby allowing the engaging portion 32 to engage the e-clip 18 during usage.

F. Operation of Invention

Figure 10:
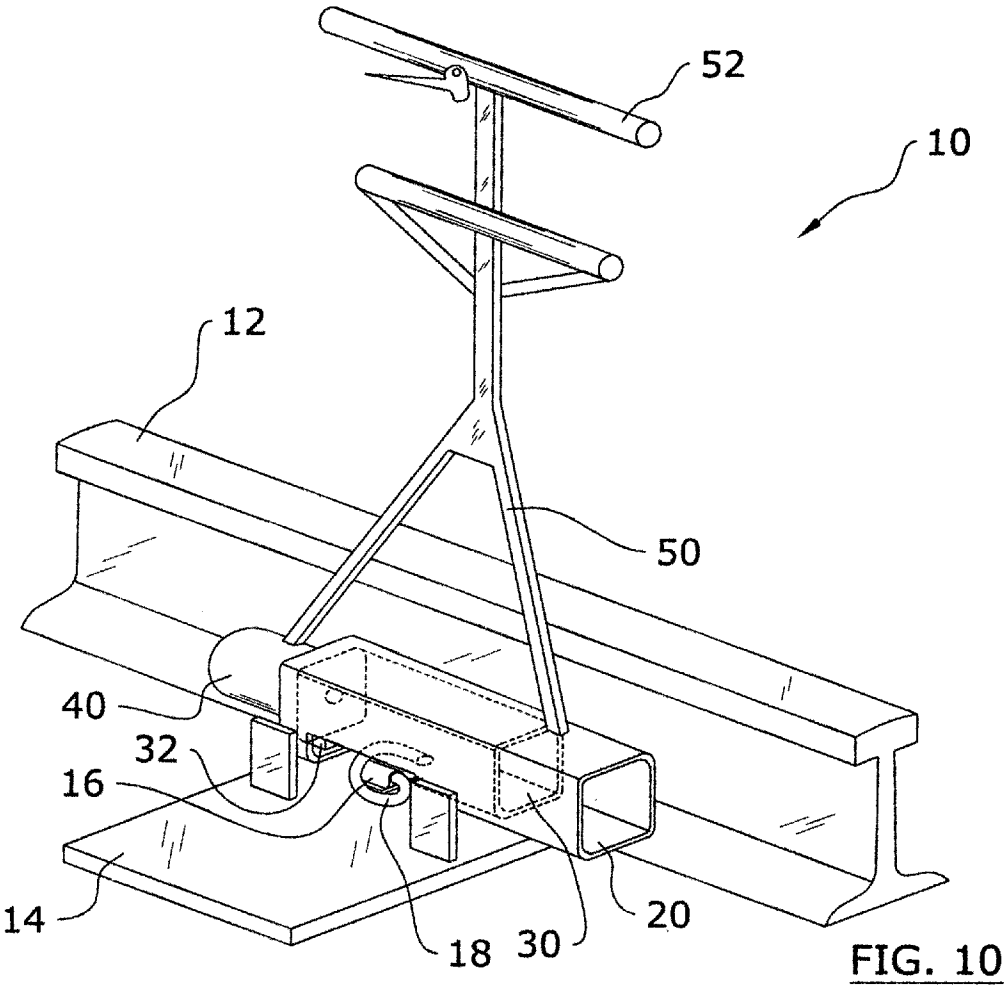
FIG. 10 is an upper perspective view of the present invention positioned about an e-clip to be removed.

In use, the user positions the present invention over the e-clip 18 to be removed as shown in FIG. 10 of the drawings. After the present invention is properly positioned, the actuator unit 40 is thereafter extended thereby causing the engaging portion 32 to engage the upper exposed portion of the e-clip 18 as shown in FIG. 11 of the drawings. The engaging portion 32 continues to force the e-clip 18 outwardly from the tubular support member 16 of the rail pad 14 as the toe portion of the e-clip 18 slides along the rail foot of the rail member 12. The actuator continues extending until the e-clip 18 is fully removed from the tubular support member 16. The user then simply lifts the present invention from the work area and is able to retrieve the removed e-clip 18.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A railroad e-clip removal system, comprising:

an outer tube with an outer cutout;

an inner tube slidably positioned within a lumen of said outer tube, wherein said inner tube includes an inner cutout and an engaging portion, wherein said engaging portion is engageable to an e-clip; and an actuator unit attached to said outer tube, wherein said actuator unit includes a shaft member that is attached to said inner tube for extending/retracting said inner tube within said outer tube.

2. The railroad e-clip removal system of claim 1, wherein said engaging portion is a lower rear edge of said inner cutout.

3. The railroad e-clip removal system of claim 1, wherein said engaging portion is positioned near a rear portion of said outer cutout when said inner tube is retracted.

4. The railroad e-clip removal system of claim 1, wherein said engaging portion extends below said outer cutout for engaging an e-clip.

5. The railroad e-clip removal system of claim 1, wherein said outer tube and said outer tube have a similar cross sectional shape.

6. The railroad e-clip removal system of claim 1, including a plurality of legs attached to said outer tube.

7. The railroad e-clip removal system of claim 6, wherein one of said legs is engageable to a tubular support member during removal of an e-clip.

8. The railroad e-clip removal system of claim 6, wherein one of said legs is shorter than the remaining legs and has a flanged portion for being positioned upon a rail foot of a rail member.

9. The railroad e-clip removal system of claim 1, wherein said outer tube is longer than said inner tube.

10. The railroad e-clip removal system of claim 1, wherein said outer cutout and said inner cutout are similar in position and size.

11. A railroad e-clip removal system, comprising:

an outer tube with an outer cutout;

a support structure having a handle member attached to said outer tube;

an inner tube slidably positioned within a lumen of said outer tube, wherein said inner tube includes an inner cutout and an engaging portion, wherein said engaging portion is engageable to an e-clip; and an actuator unit attached to said outer tube, wherein said actuator unit includes a shaft member that is attached to said inner tube for extending/retracting said inner tube within said outer tube.

12. The railroad e-clip removal system of claim 11, wherein said engaging portion is a lower rear edge of said inner cutout.

13. The railroad e-clip removal system of claim 11, wherein said engaging portion is positioned near a rear portion of said outer cutout when said inner tube is retracted.

14. The railroad e-clip removal system of claim 11, wherein said engaging portion extends below said outer cutout for engaging an e-clip.

15. The railroad e-clip removal system of claim 11, wherein said outer tube and said outer tube have a similar cross sectional shape.

16. The railroad e-clip removal system of claim 11, including a plurality of legs attached to said outer tube.

17. The railroad e-clip removal system of claim 16, wherein one of said legs is engageable to a tubular support member during removal of an e-clip.

18. The railroad e-clip removal system of claim 16, wherein one of said legs is shorter than the remaining legs and has a flanged portion for being positioned upon a rail foot of a rail member.

19. The railroad e-clip removal system of claim 11, wherein said outer tube is longer than said inner tube.

* * * * *